United States Patent [19]

Westhed

[11] Patent Number: 5,058,348

[45] Date of Patent: Oct. 22, 1991

[54] METHOD AND APPARATUS FOR FORMING A PATH FOR A SCREEDING MEANS

[76] Inventor: Pell Sune Westhed, Dalagatan 10, Rättvik, Sweden, S-795 00

[21] Appl. No.: 435,453

[22] PCT Filed: May 30, 1988

[86] PCT No.: PCT/SE88/00292

§ 371 Date: Nov. 21, 1989

§ 102(e) Date: Nov. 21, 1989

[87] PCT Pub. No.: WO88/09853

PCT Pub. Date: Dec. 15, 1988

[30] Foreign Application Priority Data

Jun. 1, 1987 [SE] Sweden ..... 8702270
Oct. 29, 1987 [SE] Sweden ..... 8704229

[51] Int. Cl.[5] ..... E04C 3/16

[52] U.S. Cl. ..... 52/365; 52/126.6; 52/678; 52/687

[58] Field of Search ..... 52/364, 378, 677, 678, 52/684, 687, 688, 365, 126.1, 126.4, 126.5, 126.6, 126.7

[56] References Cited

U.S. PATENT DOCUMENTS

| | | | |
|---|---|---|---|
| 2,823,539 | 2/1958 | Kersh et al. | 72/128 |
| 3,579,938 | 5/1969 | Hanson | 52/365 |
| 4,325,533 | 4/1982 | Tiletschke et al. | 249/188 |
| 4,338,757 | 7/1982 | Witschi et al. | 52/378 X |
| 4,468,907 | 9/1984 | Tiletschke et al. | 52/378 X |
| 4,549,384 | 10/1985 | Brechbühler | 52/378 X |
| 4,562,679 | 1/1986 | Pattiszlanno | 52/378 |
| 4,598,517 | 7/1986 | Alvarsson | 52/364 |

FOREIGN PATENT DOCUMENTS

| | | |
|---|---|---|
| 0079298 | 5/1983 | European Pat. Off. . |
| 3121632 | 12/1982 | Fed. Rep. of Germany . |
| 3201918 | 8/1983 | Fed. Rep. of Germany . |
| 3220847 | 12/1983 | Fed. Rep. of Germany . |
| 222146 | 1/1967 | Sweden . |
| 370748 | 10/1974 | Sweden . |
| 439029 | 5/1985 | Sweden . |
| 86-019205 | 6/1986 | Sweden . |

*Primary Examiner*—Richard E. Chilcot, Jr.
*Assistant Examiner*—Linda J. Watson
*Attorney, Agent, or Firm*—Witherspoon & Hargest

[57] ABSTRACT

The invention relates to a method for forming a screed guide for a vibrating screed or the like in connection with the casting and direct smoothing of especially single-course structural floors and at the locations where the walls of the next story are to be cast. According to the invention an elongate support frame (1), which is intended to be cast into the structural floor, is positioned at the location for the walls of the next story, reinforcement bars (12) intended to be cast into the walls, are introduced into the screeding profile with first portions thereof extended downwardly in order to be cast into the strucutural floor, and with second portions thereof extended upwardly from the screeding profile (2), the second portions of the reinforcement bars (12) are bent down to a horizontal position in screeding profile, a cover (14) is positioned on the screeding profile, said cover covering the horizontally bent second portions of the reinforcement bars (12), whereby the cover serves as a screed guide for the vibrating screed when screeding the structural floor on both sides of the wall of the next story, and the cover (14) is removed after the casting and screeding so that the reinforcement bars are exposed and then may be bent upwardly.

1 Claim, 4 Drawing Sheets

METHOD AND APPARATUS FOR FORMING A PATH FOR A SCREEDING MEANS

The present invention relates to a method and an apparatus for use in connection with the casting and direct smoothing of single-course structural floors, and more specifically for forming a screed guide, i.e. a path for a screeding means, such as a vibrating screed or the like, at the locations where the walls of the following story are to be cast.

BACKGROUND OF THE INVENTION

When casting single-course structural floors, where the concrete is cast in a floor shuttering and is screeded or smoothed directly and forms the base for flooring, a specific screeding beam has to be positioned and levelled. This screeding beam acts as a support for the so called vibrating screed or vibrating beam finisher when screeding the concrete, and may be one of two different basic types, of which one has to be dismounted or removed after the casting while the other may remain in the structural floor, i.e. it is cast into the concrete.

When casting and direct smoothing a single-course structural floor in this manner it has up to now been necessary to provide such a screeding beam on each side of the location where the walls of the following story are to be cast, since the anchorage or protective reinforcement to be cast into these walls extends vertically upwardly from the floor shuttering and prevents the use of a common screeding beam for screeding or smoothing the structural floor on both sides of the location for the wall. The protruding anchorage or protective reinforcement creates a great problem also from another point of view, since it involves a fairly great accident risk, even if the protruding reinforcement bars are provided with protective knobs of plastic or the like.

When casting single-course structural floors in the traditional or conventional manner separate supports must also be provided for the top-layer reinforcement, and up to now these supports have been formed by bent reinforcement bars, so called "cats feet", which involves relatively time-consuming work. Using conventional technique it is moreover relatively complicated and time-consuming to adjust or adapt both the top-layer reinforcement and the screeding beams to the thickness of the structural floor in question.

Another disadvantage of the conventional technique resides in the fact that when the casting has to be interrupted temporarily, for instance to be resumed the following day, a special casting joint support or "stop support" has to be installed, which is time-consuming and involves additional costs.

OBJECT OF THE INVENTION

Accordingly, the object of the present invention is to provide a method and an apparatus of the aforementioned kind, by means of which the above discussed drawbacks of the prior art may be eliminated as far as possible.

According to the invention this object is accomplished by means of a method and an apparatus as described herein.

BRIEF DESCRIPTION OF THE DRAWINGS

The invention will be described in detail, with reference to the enclosed drawings, on which.

DETAILED DESCRIPTION OF THE INVENTION

Figure 1:
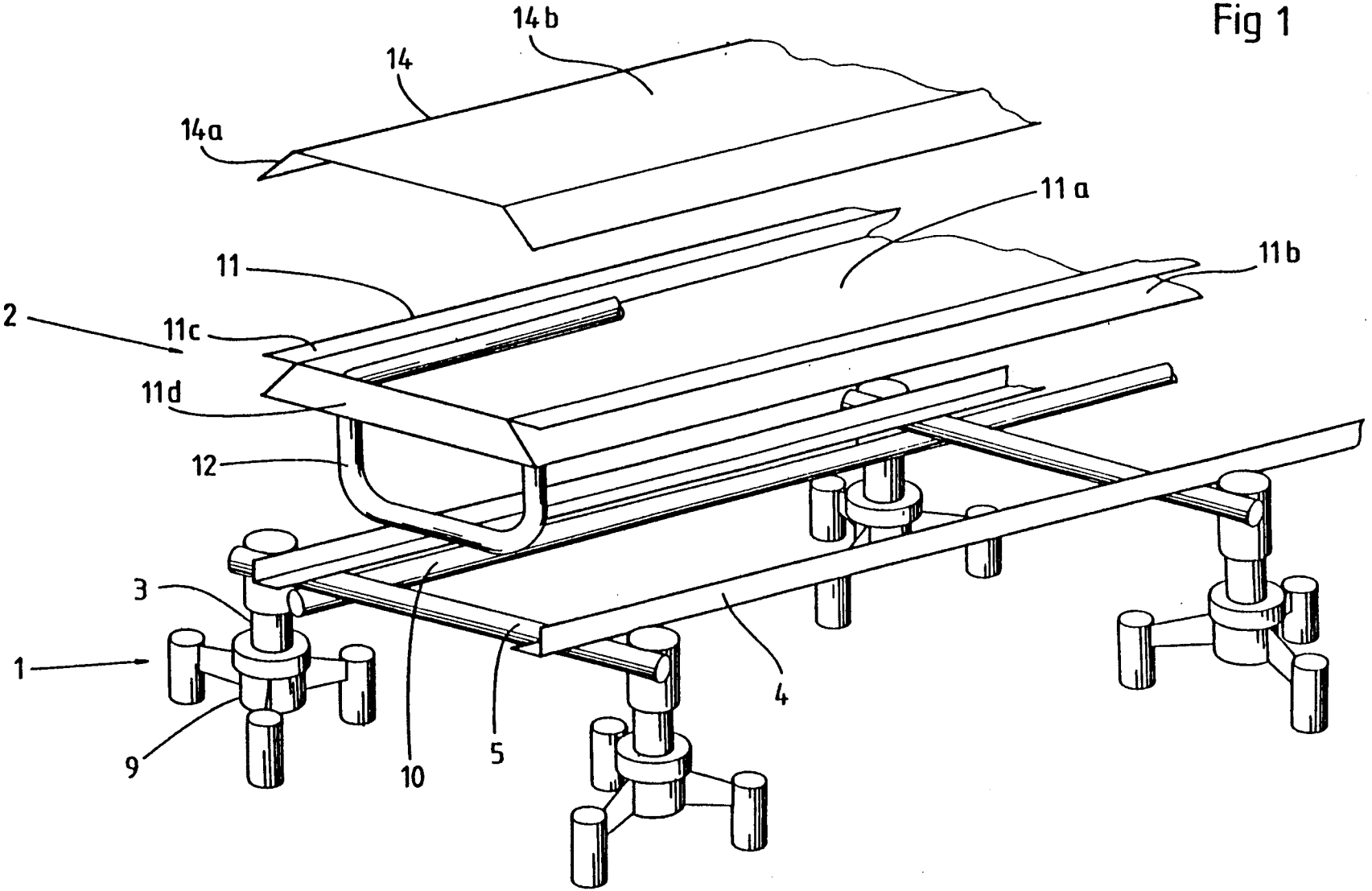
FIG. 1 is a perspective view of a portion of an apparatus according to the invention for forming a screed guide, and illustrates the screeding profile and the cover in a separated position.

As illustrated especially in FIG. 1, the apparatus according to the invention basically consists of a support frame 1 and a screeding profile 2 supported thereon. The support frame 1 (compare also with FIG. 3) consists of a plurality of yokes 3 generally having the shape of an inverted U. The yokes are provided at mutual distances from each other in a row and are connected by means of a pair of angle bars 4 facing each other and being welded to the upper side of a connecting piece 5 forming the web of the U-shape of each yoke. The connecting piece may preferably consist of a round iron or the like.

The legs of the yokes 3, i.e. the shanks of the U-shape, consist of a sleeve 6 being welded to the respective end of the connecting piece 5. A threaded bolt 7 is driven into the sleeve 6. The threaded bolt engages a nut 8 which in turn is rotatably journalled in a foot 9 for supporting the apparatus on the floor shuttering or the like. The foot 9, the nut 8 and possibly the bolt 7 may be manufactured from a suitable plastic and the nut 8 and the threaded bolt 7 are intended for height adjustment of the screed guide, as will be discussed more closely below.

A support 10 for top-layer reinforcement is welded to the lower side of the connecting piece 5, at a position between the legs of the yoke 3, and said support extends along the full length of the apparatus and preferably consists of a round iron or reinforcement bar. To a certain extent the support 10 for top-layer reinforcement also serves to stiffen the apparatus.

The screeding profile 2 which is intended to be mounted between the angle bars 4 of the support frame 1, consists of a channel-like profiled plate 11 having side walls 11*b* converging to some extent from its bottom 11*a* and outwardly projecting upper flanges 11*c* at the upper ends of the walls 11*b*. Preferably the profiled plate 11 is also provided with end walls 11*d* at the short ends thereof.

Figure 2:
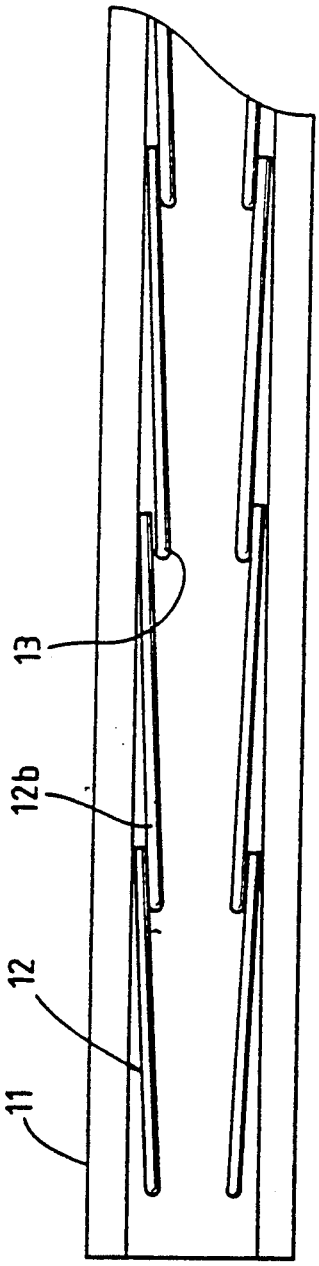
FIG. 2 is an elevational view from above of the screeding profile with the cover removed.
Figure 3:
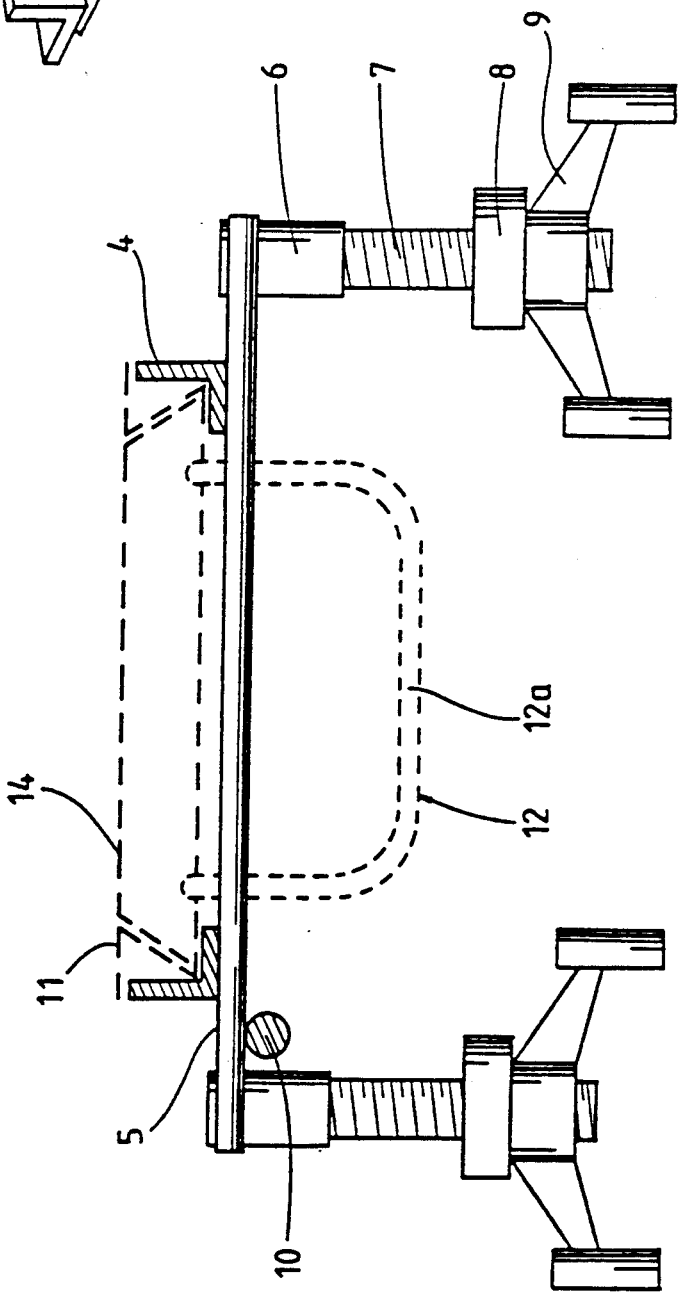
FIG. 3 is an end view of the support for the apparatus.

FIGS. 1, 2 and 3 illustrate that reinforcement bars 12 are provided in the channel-like profiled plate 11. According to a preferred embodiment these reinforcement bars 12, which form the anchorage or protective reinforcement to be cast into the walls of the following story, are fitted into the profiled plate 11 with a first central portion 12*a* thereof, which portion is bent to a general U-shape, positioned below the profiled plate 11 and with the remaining portions 12*b*, i.e. the free ends thereof, passed through bores 13 through the bottom 11*a* of the profiled plate 11 and bent down into or folded into the channel of the profiled plate 11.

The screeding profile 2 also consists of a cover 14 having side walls 14*a* converging towards its upper portion 14*b* at an angle substantially corresponding to that of the side walls 11*b* of the profiled plate 11. As a result of this the cover 14 may be fitted with its side walls 14*a* extending into the channel of the profiled plate 11, so that it may prevent concrete from entering the channel during the casting and so that its upper portion 14*b* together with the flanges 11*c* of the profiled plate 11 may form the actual screed guide for the vibrating beam screed.

In the case where the casting of the structural floor has to be temporarily interrupted the apparatus of the invention may easily be combined with a "stop support" or casting joint support 15 (see FIG. 5) which is preferably manufactured from steel plate and which is welded to the connecting piece 5 of the yoke 3. As a result a straight and smooth joint may be obtained without the need for any specific, separate concrete casting joint support apparatus.

Figure 4:
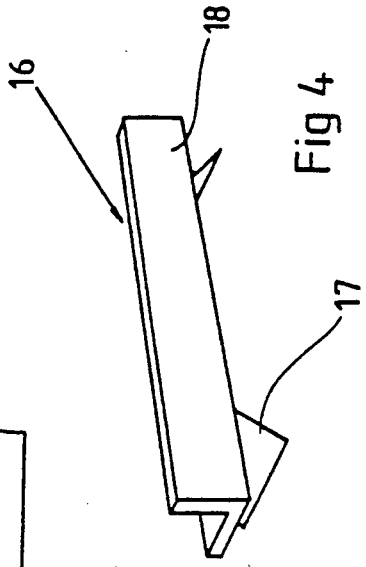
FIG. 4 illustrates a spacing piece for a wall formwork.

FIG. 4 illustrates a spacing means 16 which may advantageously be employed together with the apparatus according to the invention when setting the form for the walls of the next story. The spacing means consists of a sheet iron 17 bent to a profile corresponding to that of the cover 14 and a stop 18 for the wall formwork. The stop 18 has the shape of an angle piece, is manufactured from plastic or the like and is attached to the web of the sheet iron 17. Due to the fact that the sheet iron has a profile corresponding to that of the cover, the sheet iron may, once the cover 14 has been removed from the channel of the profiled plate 11, be inserted into the channel with its legs, whereby the stop 18 will project outwardly from each side of the screeding profile so that it forms a support for the sides of the wall formwork which may accordingly be easily and quickly installed at the correct distance. The stop is attached to the sheet iron by means of a self-tapping screw, once it has been adjusted to the correct position.

Figure 5:
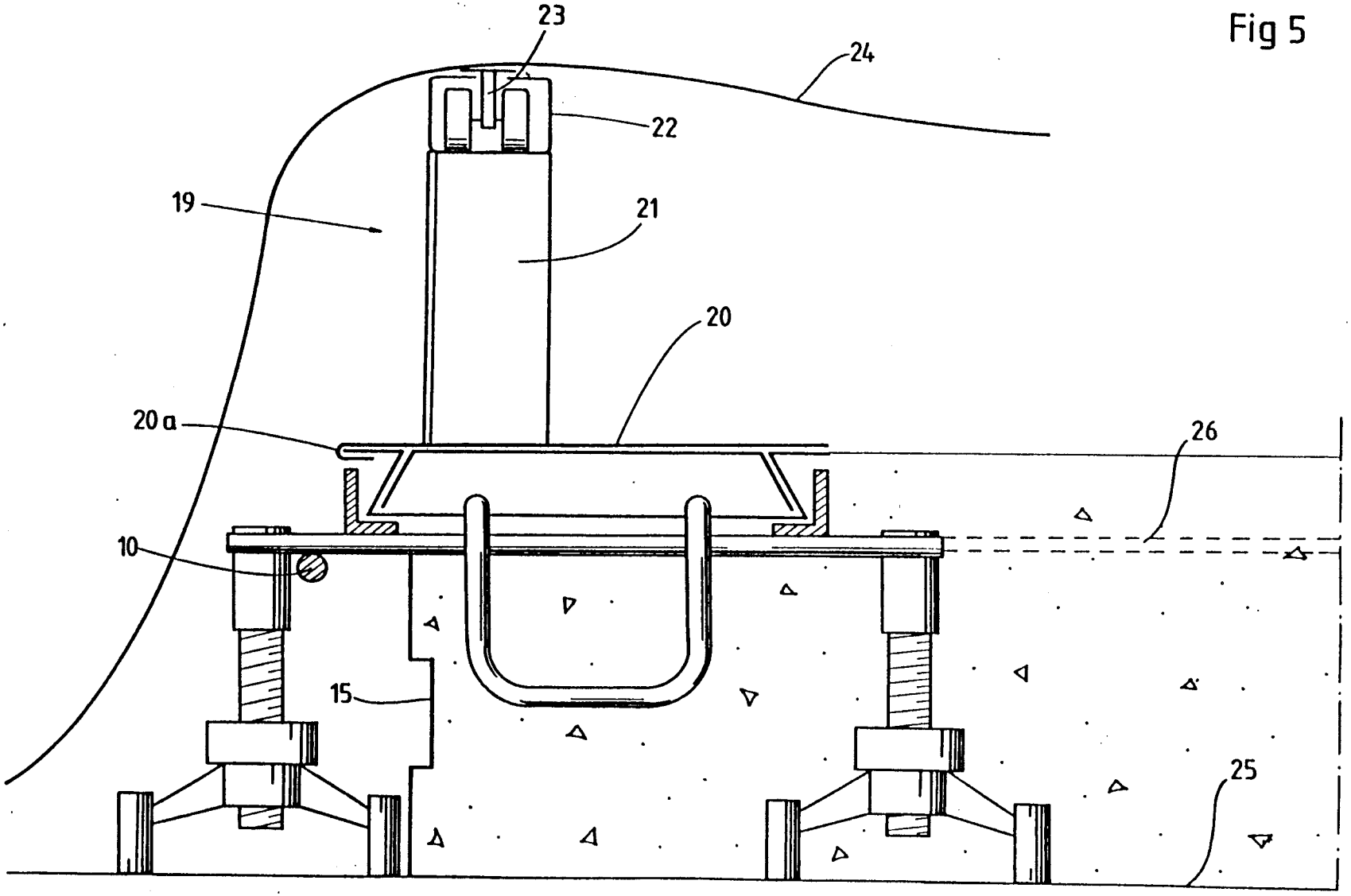
FIG. 5 is a cross-section illustrating the apparatus according to the invention cast into a structural floor and supplemented with a weather covering.
Figure 6:
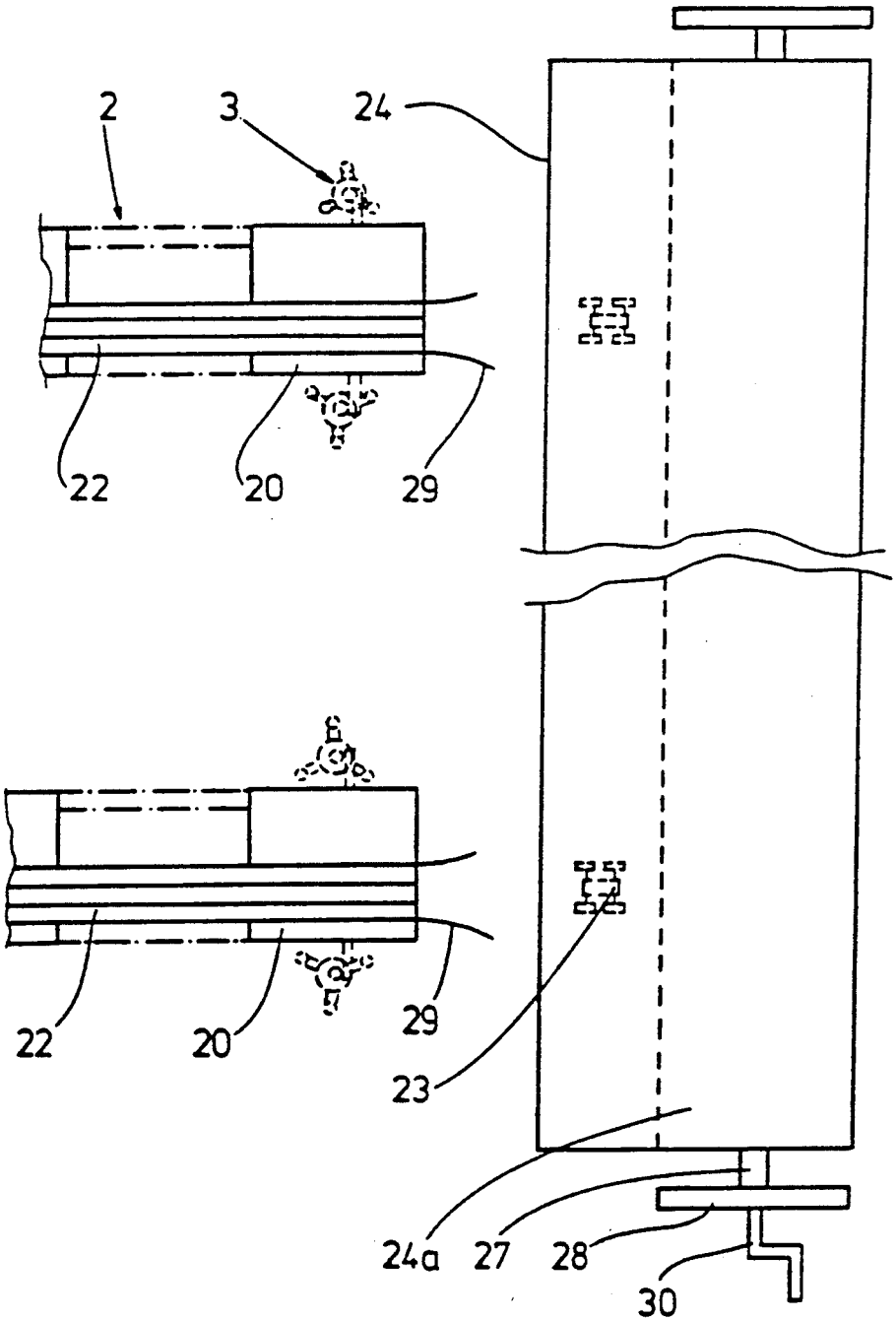
FIG. 6 is an elevational view from above, schematically illustrating the use of the weather covering.

FIGS. 5 and 6 schematically illustrate the structure of a weather protection 19, especially adapted for use together with the screeding apparatus according to the invention and for protecting the newly cast portion of the structural floor from rain and cold weather. As illustrated in FIG. 5 the weather protection basically consists of at least one track in which carriages are intended to run, whereby the track is formed by a number of flat bar steels 20 which along one of their longitudinal edges are bent 180° for forming an edge folding 20*a* intended to engage one of the upper flanges 11*c* of the profiled plate 11. Upright L-irons 21 are welded to the flat bar steels 20. At their upper ends the L-irons 21 support a rail 22 in which carriages 23 run, which carriages are provided with rolls. Due to the fact that the carriages are attached to the underside of a canvas or tarpaulin 24, in a row with a mutual distance of for instance 50 cm, the canvas may easily be extended across the cast structural floor by guiding the carriages attached to the canvas into the rail 22 and from one of its ends towards its other end.

When using the weather protection it is suitable to employ two tracks of the kind described above, as illustrated in FIG. 6. Each of said tracks is attached to one of two spaced, parallel screeding profiles in the structural floor. The carriages are attached to the underside of the canvas 24 in two parallel rows with a corresponding spacing between the rows. The canvas 24 is in turn wound up in a roll 24*a* on a shaft 27 being rotatably journalled in a support 28 which is preferably positioned outside the structural floor, on the formwork. When covering the structural floor the canvas is pulled out and unrolled from the shaft and simultaneously the carriages 23 are guided into the respective rail 22, preferably by means of a guide 29 automatically guiding the carriages into the respective rail. In this manner the complete canvas 24 is pulled out across the newly cast structural floor and provides a safe protection for the floor without any danger of the canvas hanging down into the concrete. A crank 30 is preferably attached to the rotatable shaft which is journalled in the support 28, and by means of this crank the canvas may be rewound.

The method according to the invention will now be described with specific reference to the use of the above described screeding apparatus. The support frame 1, which like the screeding profile 2 is preferably manufactured with a length of for instance 2400 mm, and which consists of the yokes 3 and the angle irons 4, is positioned with its feet 9 resting on the floor shuttering 25 at a location where a wall of the next story is to be cast. Possibly the feet 9 of the yokes are nailed to the floor shuttering.

The ancorage or protective reinforcement for the wall is inserted from below through the holes 13 in the bottom of the profiled plate 11, whereupon the upper, free ends of the reinforcement bars 12 are folded or bent downwardly so that they lie in the channel formed by the profiled plate. Subsequently the channel and thereby the reinforcement bars 12 are covered by means of the cover 14, whereupon the screeding profile is mounted on the support frame, resting on the angle irons 4. Naturally the screeding profile may be prefabricated so that it will only have to be cut into the required length at the building site.

After mounting the screeding profile 2 in the support frame 1 the apparatus is adjusted in height by means of the height-adjustment means consisting of the nut 8 and the threaded bolt 7. Due to the fact that the nut 8 is rotatably journalled in the foot 9, i.e. it is rotatable but is vertically fixed or stationary, the height of the yoke 3 and thereby of the screeding profile 2 may be increased or decreased by means of the corresponding rotation of the nut 8. Due to this rotation of the nut 8 the threaded bolt is screwed into or screwed out from respectively the stationary nut. Preferably the height of the apparatus may be adjusted within the area of 180–300 mm.

When the height of the apparatus has been adjusted the top-layer reinforcement 26 (indicated in FIG. 5) is laid out on the support 10 and is tied or clenched.

The concrete may now be cast and screeded or direct smoothed by means of a vibrating beam finisher or vibrating screed supported on the path or guide formed by the screeding profile. Due to the fact that the anchorage or protective reinforcement for the wall is folded or bent into the channel of the profiled plate 11, which in turn is covered by the cover 14 which together with the flanges 11*c* form the actual screed guide or path and prevent concrete from entering the channel, the structural floor on both sides of each wall may be screeded using the same apparatus as support, i.e. instead of the conventional method of providing one screeding beam on each side of the wall, it is now sufficient to provide one apparatus according to the invention positioned in such a way that it straddles the location for the wall. This means that the number of screeding beams may be reduced by half, which in turn means substantial cost saving.

When the structural floor has been cast the cover 14 is removed and the reinforcement bars 12 are bent upwardly to be cast into the wall. Accordingly, the present invention also brings about the advantage that during the complete casting no upwardly projecting reinforcement exists, which might otherwise cause an accident. Instead, the reinforcement will simply have to be bent upwardly directly prior to setting the wall formwork.

Although the invention has been described herein with specific reference to a preferred embodiment thereof, it should be obvious that this embodiment is only an example and that the invention is not restricted to this embodiment but also covers modifications and alterations that are obvious to the man skilled in the art. Thus, the scope of the invention shall only be restricted by the enclosed patent claims.

I claim:

1. A method of forming a screed guide for use with a vibrating-type screed and the like in connection with casting and direct smoothing of such structure as a single-course structural floor, and at locations where walls of a next story are to be cast, comprising the steps of:

disposing an elongated support frame, which is intended to be cast into said structural floor, at a location spanning both sides of a wall of said additional story;

providing a screeding profile in the shape of a channel-like profiled plate at an upper portion of said elongated support frame, whereby reinforcement bars, intended to be cast into said wall, are introduced into said profiled plate with first portions of said bars extended downwardly in order to be cast into said structural floor and with second portions of said bars being bent downwardly to a horizontal position in said profiled plate;

positioning a cover, which serves as a screeding guide, on said screening profile so that said cover covers said second portions of said reinforcement bars, said cover being employed together with portions of side walls of said screeding profile as a screeding guide for a screed;

guiding said screed upon said cover and said side walls and screeding said structural floor on both sides of said wall of said next story;

removing said cover after screeding, in order to expose said reinforcement bars, and bending said reinforcement bars upwardly.

* * * * *